US005642838A

United States Patent [19]

Stoody

[11] Patent Number: 5,642,838

[45] Date of Patent: Jul. 1, 1997

[54] FRANGIBLE SEALING LID FOR SPILE ACCESS

[76] Inventor: William Robert Stoody, 39345 Calle San Clemente, Murrieta, Calif. 92562

[21] Appl. No.: 579,830

[22] Filed: Dec. 28, 1995

[51] Int. Cl.[6] ..... B67D 5/00

[52] U.S. Cl. ..... 222/83; 222/105; 222/82

[58] Field of Search ..... 222/82, 83, 88, 222/95, 105, 130, 183, 325, 386.5, 382, 383.1, 321.7, 541.2, 541.6

[56] References Cited

U.S. PATENT DOCUMENTS

| | | | |
|---|---|---|---|
| 2,028,175 | 1/1936 | Waite | 222/83 |
| 3,421,698 | 1/1969 | Baltzer | 222/386.5 |
| 3,655,096 | 4/1972 | Easter | 222/82 |
| 4,457,455 | 7/1984 | Meshberg | 222/82 |
| 5,025,955 | 6/1991 | Stenger | 222/82 |
| 5,156,299 | 10/1992 | De Caluwe et al. | 222/82 |

*Primary Examiner*—Philippe Derakshani

[57] ABSTRACT

A spile accommodating plastic lid, having a transverse closure wall, for sealed closure of jars, bottles, pouches and like fluent material conveyances that must be accessed for issuance of material contained therein. The closure wall is provided with a circular breakout area having a frangible periphery that facilitates mounting of a hollow push-in-place spile onto the lid, wherein, a tubular portion of the spile extends through the lid. The breakout area is constructed such that the frangible periphery yields and ruptures in a prescribed circular manner under push-in-place mounting of the spile. The breakout area is further constructed such that upon rupture of the frangible periphery it is pushed through and inwardly hinged so as to establish a hole having an inwardly turned periphery which functions as a biased annular lip seal that sealingly embraces the extended tubular portion of the spile. Hinging of the breakout area is facilitated by the frangible periphery being interrupted whereby a portion or the periphery is nonfrangible. The bole and the displaced breakout area remain linked by an unbroken span of plastic material that functions as a connecting hinge.

15 Claims, 3 Drawing Sheets

FRANGIBLE SEALING LID FOR SPILE ACCESS

RELATED INVENTIONS

Applicant's inventions entitled Rigidly Brimmed Wide Mouth Stretch Resistant Pouch, U.S. Pat. No. 5,476,322 issued Dec. 19, 1995, and Lidded Wide Mouth, Stretch Resistant Pouch, patent application Ser. No. 08/515,489, filed Aug. 15, 1995, are related to the present invention only to the extent that they disclose wide mouth pouches which contain dispensable material.

PRIOR ART

U.S. Pat. No. 3,421,698 issued Jan. 14, 1969 to Walter Blatzer and U.S. Pat. No. 4,232,721 issued Nov. 11, 1980 to Martin et al. disclose pouch closures having a membrane piercing site surrounded by an outboard sealing means. In both inventions a hollow piercing spike, being a substantially large diameter tube that is tapered to a sharp point at one end, is pushed through the membrane piercing site to gain access to liquid disposed in a pouch.

In the Martin et al. invention the outboard sealing means is a tubular access member that effects a seal around the piercing spike outboard of a plastic membrane piercing site. The Martin et. al. outboard sealing arrangement is necessary to compensate for the piercing site leak paths.

Similar to the Martin et. al. invention, Baltzer's invention relies on a sealing plate, from which a piercing spike depends, to seal off the piercing site, In both of these inventions sealing outboard of the piercing site is necessary due to leak paths, produced by uncontrolled radial tearing and splitting of the piercing site membrane, that results from the membrane being stretched beyond its elastic limit.

It is well to understand that the sharp pointed end of the piercing spike first penetrates the membrane establishing a ragged pierced hole and as the piercing spike proceeds through the membrane the spike continues to expand the pierced hole thereby causing the perimeter membrane to be stretched beyond its elastic limit and yield so as to produce splits and tears. Thus, in both the Martin et. al. and Baltzer's inventions splitting and tearing of the pierced hole perimeter membrane at the piercing site is unavoidable. Therefore, an outboard sealing means is necessary.

It is appreciated that there are other well known lids, that are commercially available for dispensing granulated and liquid products, that have a breakout zone. These well known lids are provided with a substantially rigid breakaway zone, having a frangible periphery, that merely enables open access to product disposed in a container. There is no means for effecting a seal after breakaway zone periphery has been ruptured.

The distinction between prior art lids and the present invention is that the present invention provides for the first time a lid having a breakout area that maintains a seal before being opened, while being opened and subsequent to being opened, The breakout area of the present invention is unique in that it is hinged inwardly after being separated from the remaining portion of the lid, and it provides an opening having the characteristics of elastomeric lip seals that are commonly used to seal against fluid leakage around bearing shafts.

BACKGROUND OF THE INVENTION

In general the present invention relates to a novel plastic lid used for sealing closure of a fluid filled replaceable pouch (bag) that is insertable in a reusable dispenser apparatus. More precisely the present invention pertains to a novel closure lid that is provided with a peripherally frangible breakout area, that is configured to separate in a prescribed manner, to produce a sealable circular opening in the lid. The lid is of such plastic material, for example high density polyurethane, as to possess some elastomeric qualities.

Heretofore there has been a need for a prefilled and lidded pouch (plastic bag), for containment of a dispensable fluid product, that can be conveniently placed in reusable dispensers, bottles and the like. While several versions of prefilled pouches inventions have recognized the advantages of a drop in place pouch they are still deficient since their lids must be removed or pierced in order to gain access to the contents of the pouch. Either approach, removal or piercing, is prone to inconvenient handling spillage that must be dealt with. Thus, present day needs for efficiency and convenience have not previously been satisfied. The present invention overcomes these deficiencies and in so doing provides a simple tamper evident closure lid as well.

The present invention distinguishes from prior art in that it discloses a novel lid having a hinged breakout area, which is defined by a frangible circular periphery, that is of sufficient strength to ensure against being inadvertently ruptured and of sufficient weakness to separate, upon demand, in a prescribed manner to produce a sealable circular opening.

In typical use the present invention lid is disposed on and sealingly closes a collapsible pouch, containing a dispensable product, which serves as a replaceable prefilled refill cartridge employed in a reusable dispenser. The reusable dispenser preferably consist of a bottle-like structure, having an externally threaded open end, and a corresponding screw-on cap that includes an aspirator device that communicates with contents of the pouch.

Said cap also includes a depending tubular spile that provides a flow through passageway from the interior of the pouch to said aspirator device. The spile is provided with a blunt distal end, having a circumferential diameter that is somewhat larger then that of said break out area. The spile is situated so as to be in axial alignment with the breakout area of the lid.

An act of tightening of said cap onto the bottle-like structure causes the distal end of the spile to bear pressure against said breakout area periphery, effectuating a seal and causing said periphery to stretch and yield, so as to release the breakout area. With said cap fully tightened into place, said spile sealingly protrudes through a resulting circular opening in the lid and the breakout area is hinged inwardly.

The circumferential diameter of the spile distal end, being larger than the breakout area periphery, causes said opening to have a downwardly flaired curvature whereas, the laying circular edge of said opening faces down providing the characteristics of an annular lip seal. The importance of the lip seal characteristic is that the opening cannot be inverted, by internal pressure produced within a sealingly lidded pouch, when the spile is in place. It is also important to have said faying edge face down so that said flair curvature conformingly engages the outer surface of the spile to effectuate a seal. In addition the elastomeric quality of the lid material is such that the flair curvature maintains a biased sealing engagement, analogous with a lip seal, with respect to the spile.

It needs to be realized that the structure of the present invention lid is such that in use the lid is capable of being transformed from a closure structure that reliably obturates access to contents of a container to a closure structure having an access opening that is characteristic of an elastomeric lip seal.

An advantage of the present invention is that it, now for the first time, provides a convenient and efficient method for use of prefilled flexible pouches (bags), as replaceable cartridges, in reusable dispensers. The pouch, in an unopened state, is simply placed in a reusable dispenser to provide a dispensing system that is immediately ready to issue contents from a pouch when the cap is fully tightened into place. Since there is no pre-opening operation required for the pouch, there is no risk of an inconvenient spillage.

The present invention facilitates reuse of major components of the dispenser system by providing a pouch closure lid that enables a product filled pouch to be placed, unopened, in a dispenser and be automatically opened when the dispenser cap is put into place. Reuse of the dispenser is convenient for consumers and it effectively contributes to waste management programs through source reduction of plastic materials.

It is further noted that the teachings of the present invention are not limited to prefilled pouch applications, they are applicable to lid closures for various types of conveyors, such as bottle, jars, drums, cans and tubes, used for containment of fluid material.

SUMMARY OF THE INVENTION

There is a need in household dispenser applications for a pouch closure lid that does not need to be removed to gain access to contents of the pouch.

An object of the present invention is to provide a plastic lid having a hinged breakout area with a frangible periphery that yields in a prescribed manner so as to produce a circular opening.

Another objective of the present invention is to provide a lid, as stated in the foregoing objective, that facilitates sealed access to contents of a pouch.

Another objective of the present invention is to provide a lid, as stated in the foregoing objective, being disposed on a collapsible plastic pouch whereas the pouch is disposed in a dispenser which comprises a bottle structure and a cap that includes an aspirator device and a hollow tubular spile, and whereas the breakout area of the lid is hinged inwardly providing an opening that sealingly engages the tubular spile.

Still another objective of the present invention is to provide a lid being disposed on a collapsible plastic pouch, as described in the foregoing objectives, whereas the lid is supported on the open end brim of a bottle structure.

These and other objectives will be seen from the following specifications and claims in conjunction with the appended drawings.

THE DRAWING

DETAILED DESCRIPTION OF THE INVENTION

Figure 1:
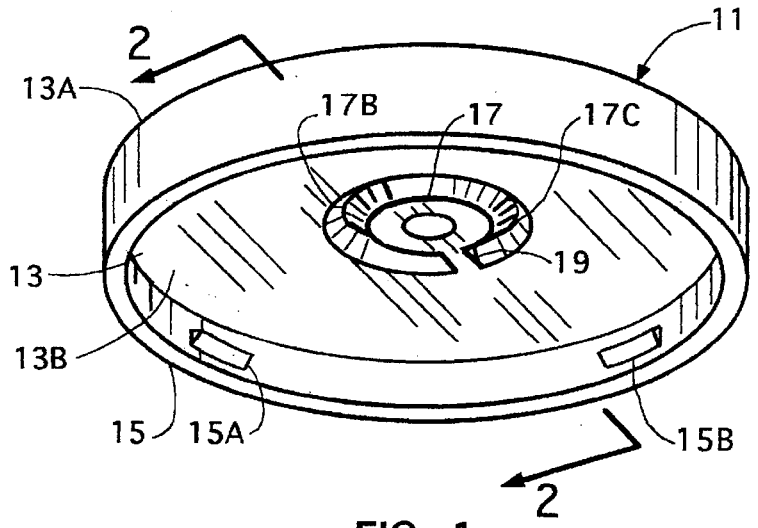
FIG. 1 is an isomeric bottom view, of the lid of the present invention, which best depicts frangible breakout area features of the lid in a closed state.

Now referring to the drawing, a preferred embodiment of the present invention lid, which is designated 11, is depicted in FIG. I as viewed from the bottom. Lid 11 is a disc-like component that is made of high density polyethylene or other suitable plastic material having some resile memory, preferably it is produced by an injection molding process. As will be seen hereinafter, a unique aspect of lid 11 is that its construction is such that it has the ability to be transformed, while in use, from a substantially plain closure lid to a lid having a prescribed sealable access opening having the sealing characteristics of a lip seal.

In general lid 11 is a substantially conventional structure in that it has a substantially flat transverse wall 13 having an outwardly facing top surface and a downwardly facing bottom surface respectively designated 13A and 13B. Said lid also has a perimeter collar 15, that extends downwardly from said bottom surface, having an equally spaced plurality of inboard facing catch ridges. Two catch ridges representatively designated 15A and 15B are shown in FIG. 1.

Figure 2:
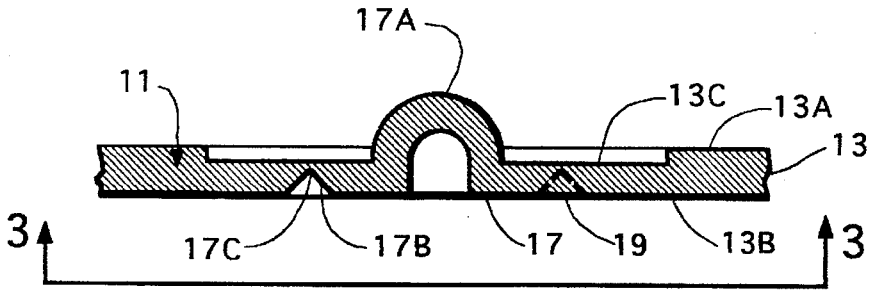
FIG. 2 is a fragmentary cross sectional side view of the lid of the present invention, taken in the direction of line 2—2 of FIG. 1, which further depicts features of the frangible breakout area portion of the lid in a closed state.

The distinguishing characteristic of lid 11 is a circular breakout area 17 having a frangible periphery, that is centrally situated on said bottom surface, and a centrally located nub 17A that projects above said top surface as seen in FIG. 2.

Said frangible periphery is characterized by a circular V-shape groove 17B, that substantially encircles said breakout area, being recessed into said bottom surface so as to provide a circular frangible membrane 17C at the root of said V-shape groove. Said frangible membrane is basically an unbroken web of lid material having a thickness that is in the range of 0.004 to 0.007 inches as measured from the root of said V-shape groove to said top surface. Thus, said frangible membrane is a sealingly continuous web of material that extends between said breakout area and said top surface when said breakout area is in a normally closed state.

Figure 3:
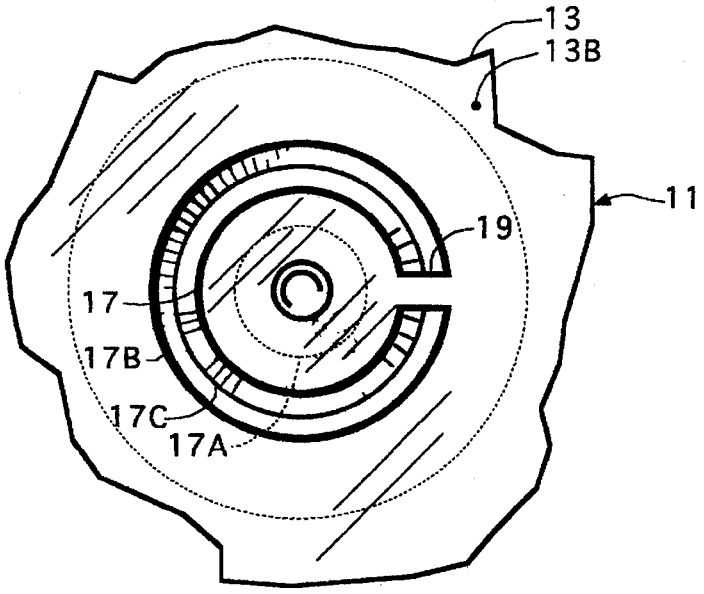
FIG. 3 is a fragmentary bottom view, taken in the direction of line 3—of FIG. 2, that also depicts the frangible breakout area in a closed state.

It can also be seen in FIGS. 1–3 that said V-shape groove does not form a complete circle, it is fillingly interrupted so as to establish a hinge 19 having a thickness that is approximately equal to the distance between said top surface and said bottom surface at said breakout area and a width dimension of approximately 0.03 inches. The dimensions of said hinge are not critical provided that there is sufficient material to establish a hinge connection between said breakout area and the remaining portion of the lid.

However, the thickness of said transverse wall in at least a 0.125 inch wide circumferential region 13C surrounding said V-shape groove is relatively thin. The thickness in said region is in the range of 0.020 to 0.030 inches. Thickness of said transverse wall outboard of said region is of substantially greater thickness so as to provide rigidity to the lid. The importance of said region wall thickness is to provide sufficient yielding and flexibility in said region to provide a sealable opening 21, as shown in FIG. 6, upon prescribed yielding of said frangible membrane and displacement of said breakout area, having a downwardly turned sealing lip as will be described hereinafter.

It should be appreciated that in describing said unique aspect of said lid it is important to understand how said lid is used and thereby transformed as stated in the foregoing. Therefore much of the following description, of the invention, will pertain to the use of said lid.

Figure 4:
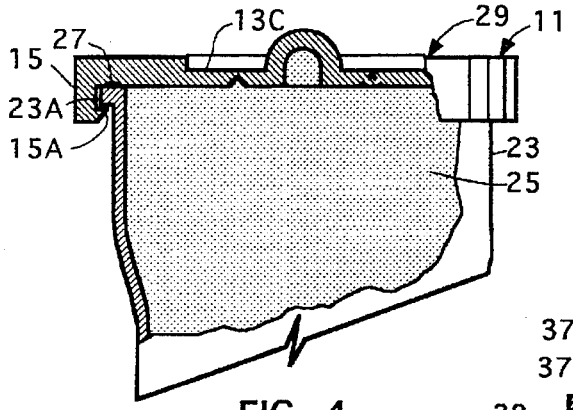
FIG. 4 is a fragmentary longitudinal view, depicting the lid of the present invention being in a closed state and disposed on a filled pouch, having portions broken away so as to reveal features of the lid with respect to the pouch.

In FIG. 4 said lid is shown being disposed on and closing a flexible pouch 23, of substantial prior art, that contains a dispensable fluid (product) 25. Said flexible pouch is provided with a radially extending open end flange 23A that is encircled by lid collar 15 and sealingly joined to said lid bottom surface by a continuous bond joint 27. Said plurality of collar catch ridges (1 shown), as represented by catch ridge designated 15A, extend inwardly beneath said flange. The primary purpose of said collar and said plurality of catch ridges is to position and hold said lid in place with respect to said open end flange prior to joining of said lid onto said pouch.

Figure 5:
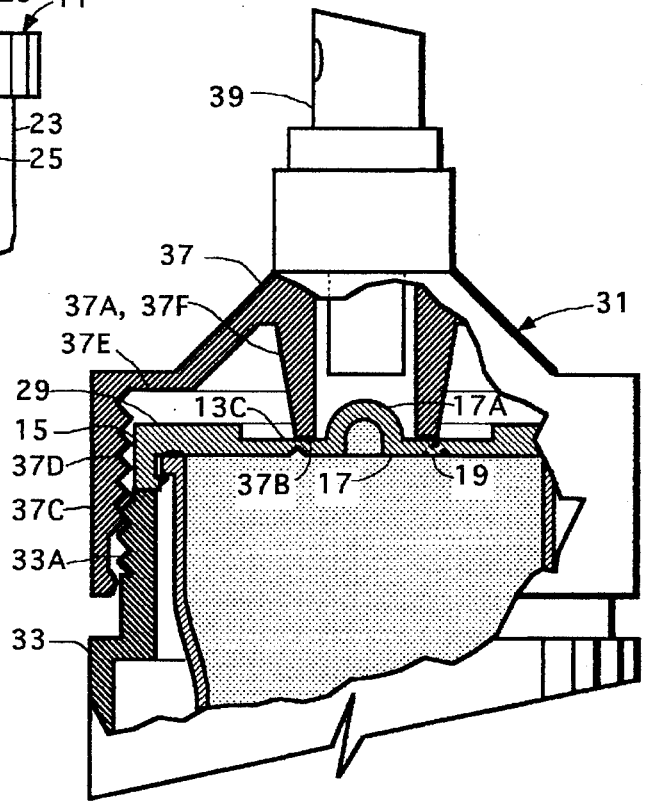
FIGS. 5 and 6 are similar fragmentary longitudinal views, which depict the lid of the present invention being disposed on a pouch and placed in a dispenser, wherein the breakout area is respectively depicted in closed state and a displaced state.
Figure 6:
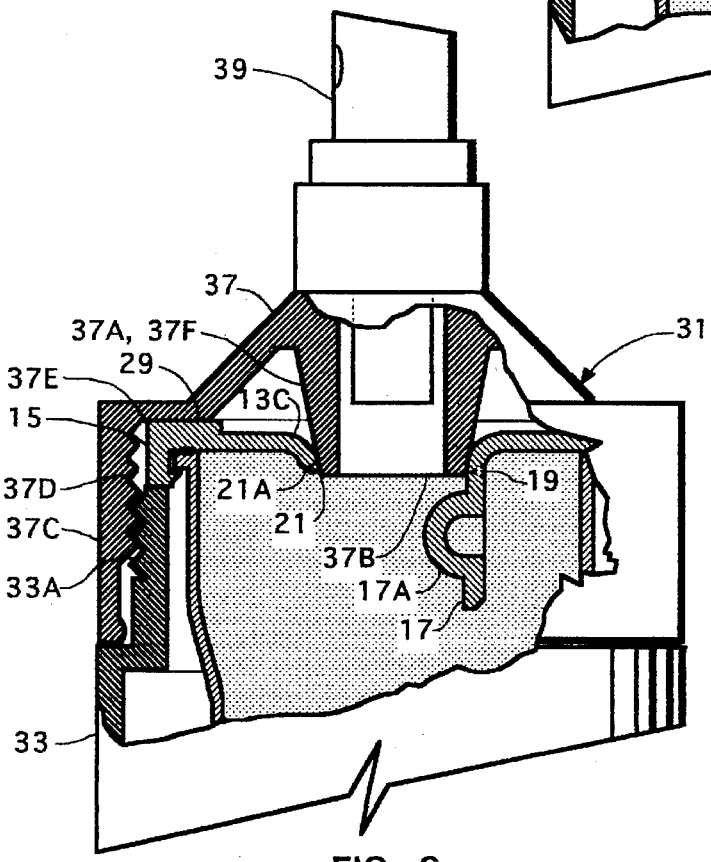

Being joined as described above, the assemblage of said lid and product filled pouch provides a drop-in-place prefilled cartridge 29 that is disposed in reusable dispenser 31 as shown in FIGS. 5 and 6. When spent (empty) said cartridge may be removed from said dispenser and replaced with a like cartridge.

Reusable dispenser 31, in its preferred embodiment, includes three substantially conventional components: a large mouth bottle-like structure 33 having a large externally threaded neck 33A; an injection molded plastic cap 37; and an aspirator device 39, for drawing fluid product from said pouch, being disposed on said cap in a substantially conventional manner. Aspirator device 39 depicted in FIGS. 5 and 6 is a standard finger operated pump.

Said cap includes an internally depending tubular spile 37A having a blunt distal end 37B, a coupling ring 37C having internal threads 37D that correspond with said externally threaded bottle-like structure neck, and an annular shoulder 37E that is situated at the distal end runout of said internal threads.

Tubular spile 37A is a unique feature not found in prior art dispensers, and it is this feature that distinguishes said reusable dispenser from conventional dispensers. Tubular spile 37A is essentially a hollow cylindrical tool that is an integral part of said cap. Said spile serves as a functional means for accessing contents of said pouch while maintaining sealing closure of said pouch, and in so doing it establishes an enclosed passageway between said aspirator and contents of said pouch. To facilitate its function said spile is provided with a blunt distal end 37B having an outside diameter that is somewhat greater than that of said V-groove. In its preferred form said spile is also provided with a slight outer surface tapper 37F.

It is noted that FIGS. 5 and 6 respectively show the first and final engagement positions of said spile, relative to said cartridge lid, when said cap is tightened into place on said bottle-like structure.

Referring to FIG. 5, said cartridge is shown being disposed within said reusable dispenser such that lid collar 15 is seated on bottle-like structure neck 33A and said filled pouch is dependingly suspended from said lid. Cap 37 is shown, in an initial (partially tightened) stage of assembly, being positioned onto said bottle-like structure neck whereas said joining ring internal threads and said bottle-like structure neck threads are engaged, and said spile distal end is aligned with said V-shape groove and sealingly seated against lid. To effect said alignment hub 17A is provided with a dome shape that is sized to fit into said spile distal end and guide said spile distal end into place, as shown in FIG. 5.

Said spile distal end is situated in a fixed relationship with said internal threads so as to be sealingly seated against said lid after internal threads 37D have initially engaged said bottle-like structure threads. Thus in the course of said engaged threads being brought to a fully tightened state said spile distal end cooperatively bears against said lid V-groove frangible membrane and increasingly applies pressure that causes said frangible membrane to reach its elastic elongation limit and then yield in a prescribed circular manner, freeing said breakout area. Said applied pressure also causes said breakout area to be displaced toward the interior of said pouch whereas said hinge hingingly secures said displaced breakout area to opening 21.

Said spile distal end, being larger in diameter than said lid V-shape groove, also acts against said lid transverse wall region 13C causing said region to be stretched and curved downwardly around said spile so as to provide opening 21 with a sealing lip, designated 21 A, that sealingly engages said spile surface 37F.

With cap 37 being in a fully tightened state, as shown in FIG. 6, cap shoulder 37E bears against said cartridge lid top surface thereby clamping said cartridge in place between said bottle-like structure neck and said cap shoulder, and said spile distal end sealingly protrudes through opening 21. And, since said lid is of a molded plastic material having some amount of resiliency sealing lip 21A maintains a tightly biased diametrical engagement with surface 37F of said spile.

Engagement of said sealing lip of opening 21 with said spile also prevents sealing lip 21A from being outwardly inverted due to internal pressure, caused to expansion of material within said cartridge, acting against said opening.

Said hinge remains intact because said prescribed yielding of said frangible membrane relieves pressure, exerted by said spile distal end, at said hinge before its elongation yield limitation is reached. Nevertheless, under the influence of said spile said hinge is compliantly turned such that it does not interfere with the formation or function of said opening 21.

Thus it should now be appreciated that lid 11 construction is such that it has the ability to be transformed, while in use, from a substantially plain closure lid to a lid having a product access opening that has sealing characteristics of a lip seal. It should also be appreciated that said transformation is an automatic occurrence that takes place by the simple act of disposing said cap onto said bottle.

MODIFICATION

Figure 7:
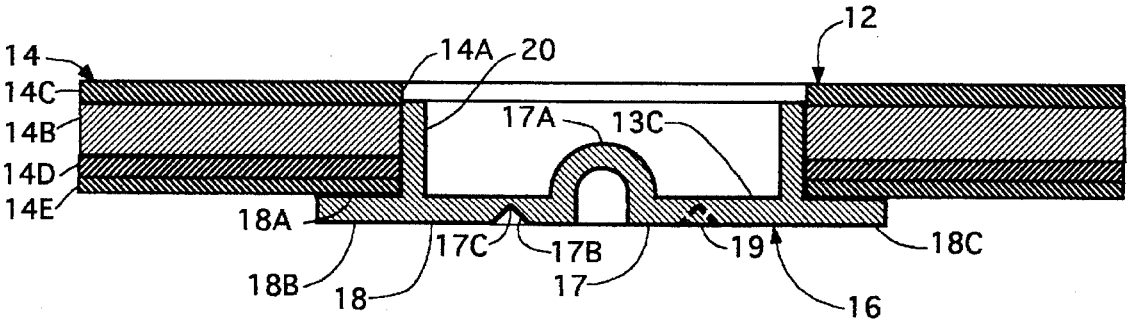
FIG. 7 is a cross sectional view similar to FIG. 2, illustrating an alternative embodiment of the present invention, wherein the lid is shown being of a laminate construction.

Shown in FIG. 7 is a modified lid 12 which is similar to lid 11. Therefore in identifying and describing features, of lid 12 which are the same as features heretofore identified and described in reference to lid 11, the respective designation numbers (odd numbers) used for lid 11 are carried forward in identifying and describing like features of lid 12. Features that are unique to lid 12 have even number designations. And, odd number features that only apply to lid 11 have been omitted. Further descriptions of heretofore identified and described features are only provided to the extent necessary to define lid 12.

The lid 11 and lid 12 are functionally alike primary difference between them is that lid 12 is an assembled component that is constructed by joining a first part and a second part together, whereas lid 11 is a one piece component.

Said first part of lid 12 is a circular primary structure 14, that is constructed from commercially available board laminate, having a through hole 14A. Preferably, as shown in FIG. 7, said board laminate is a base material, a pulp board 14B or other suitable material, having a polymeric film top surface 14C and a thin aluminum foil bottom layer 14D that is coated with a second polymer film bottom surface 14E. Said structure is of a thickness that provides lid 12 with a desired stiffness.

Said second part of lid 12 is a thin circular access panel 16 that is made of high density polyethylene or other suitable plastic material having some resile memory. Said panel has a substantially flat transverse wall 18, that is in the range of 0.020 to 0.030 inch thick, having top and bottom surfaces respectively designated 18A and 18B. Centrally located in transverse wall 18 is a frangible breakout area 17 that includes a projecting nub 17A, and a frangible periphery is characterized by a circular V-shape groove 17B that is recessed into bottom surface 18B so as to provide a circular frangible membrane 17C at the root of said V-shape groove. Said frangible breakout area also includes a hinge 19 that fillingly interrupts a small portion of said V-shape groove.

Said breakout area is positionable from a normally closed state to a displaced state wherein said membrane is in a prescribed yielded state providing a sealable opening 21 having a downwardly turned sealing lip 21 A, as heretofore described in reference to FIG. 6.

To facilitate joining of said access panel to said primary structure, said access panel is also provided with an annular vertical wall 20 that concentrically encircles said frangible breakout area and extends outwardly, from top surface 18A, for a distance that is approximately equal to the thickness of said primary structure. Vertical wall 20 is sized such that a circumferential region 13C, approximately 0.125 inch wide, is provided between said breakout area and said vertical wall. Outwards in a radial direction from said vertical wall transverse wall 18 continues for a substantial distance providing an annular flange 18C.

To produce lid 12 said access panel is positioned on the bottom surface of said primary structure such that vertical wall 20 extends into hole 14A. It is noted that hole 14A is sized to provide a slip fit engagement with said vertical wall. With said access panel so positioned, flange 18C is heat sealingly bonded to said polymer film bottom surface of said primary structure using conventional methods for heat bonding plastic materials surfaces together.

Figure 8:
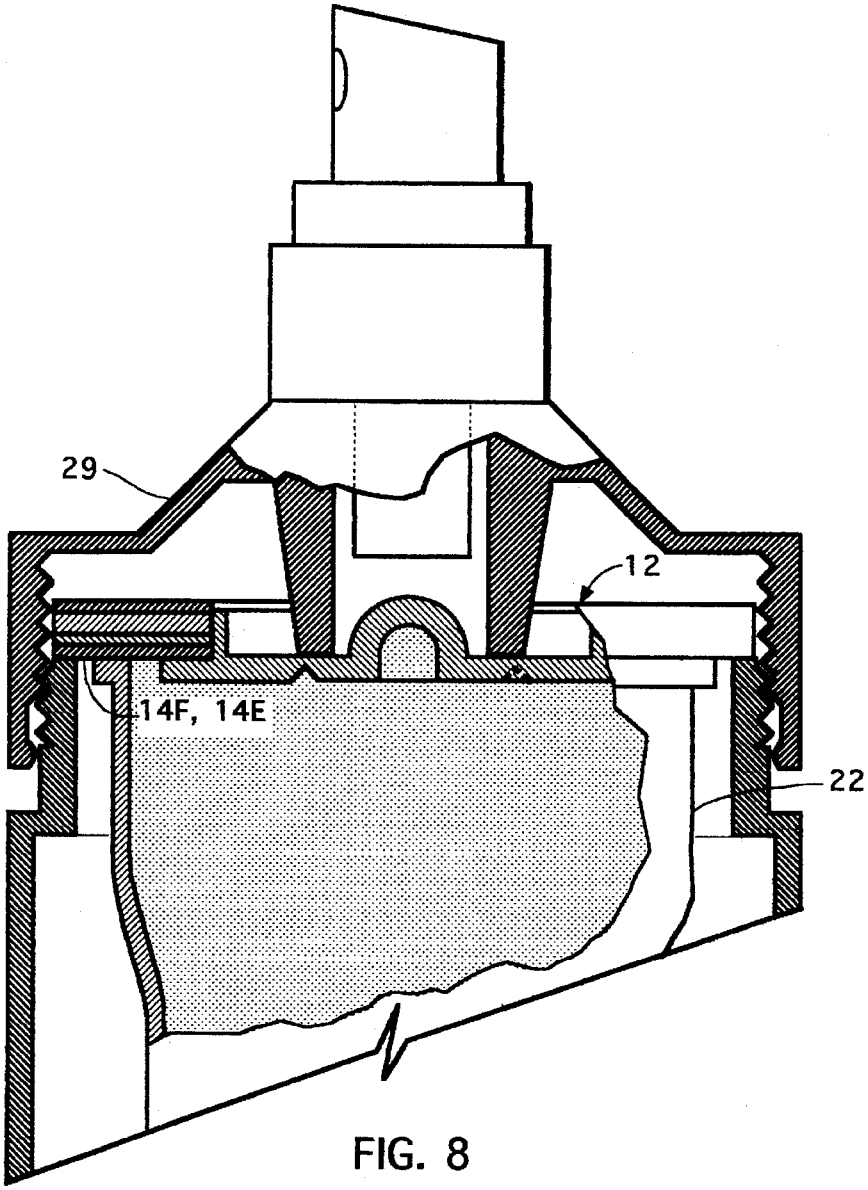
FIG. 8 is a longitudinal cross sectional view similar to FIG. 5, illustrating the alternative embodiment lid, in a closed state, being disposed on a filled pouch and placed in a dispenser.

As shown in FIG. 8 said primary structure is sized so as to provide a flange 14F that extends radially outboard of said access panel. The purpose of flange 14F is to provide a means for sealingly bonding lid 12 to a liquid filled pouch 22, and a means for support of said pouch in reusable dispenser 29.

Means for sealingly bonding of lid 12 to said pouch, is provided by bottom surface 14E of said primary structure. Since said bottom surface is of a polymer film, bonding of lid 12 to said pouch is accomplished by heat sealing (melting) bottom surface 14E of flange 14F to pouch 22 in a substantially conventional manner.

It is thought that the invention and its advantages will be understood from the foregoing description, and it is apparent that various changes may be made in the form, construction and arrangement of parts without departing from the spirit and scope of the invention or sacrificing its material advantages, the forms heretofore described and illustrated in the drawings being merely embodiments thereof.

Having described my invention, reference should now be directed to the following claims.

I claim:

1. A lid having a spile access means, for sealing closure and automatic sealed access of a filled container, which comprises:

a plastic transverse wall that includes a breakout area having a frangible periphery, an outwardly facing top surface, a downwardly facing bottom, and a hinge being provided in said frangible periphery;

said frangible periphery having a thin membrane that is sealingly continuous, between said breakout area and said top surface, with said breakout area being in a normally closed state;

said breakout area being positionable from said closed state to a displaced state wherein said frangible periphery membrane is in a prescribed yielded state providing a sealable opening, having a downwardly turned annular sealing lip, in said transverse wall;

and, wherein said hinge hingingly secures said displaced breakout area to said opening.

2. In the invention of claim 1, said lid being sealingly disposed on and closing a fluid filled pouch, wherein said filled pouch is closed.

3. In the invention of claim 2, said closed pouch being disposed in a dispenser, and said lid having a means for supporting said closed pouch in said dispenser.

4. In the invention of claim 3, a spile being situated in said dispenser and having a distal end being in sealing engagement with said frangible periphery of said lid breakout area, and said breakout area being in a closed state.

5. In the invention of claim 3, said breakout area being positional from a closed state to a displaced state;

a spile, having a distal end, being moveably disposed in said dispenser;

whereby said spile causes, prescribed yielding of said frangible periphery and thereby provides an opening having a turned down sealing lip, said breakout area to be in said displaced state, and said distal end to be sealingly protruded through said sealable opening.

6. In the invention of claim 1, said breakout area being hingingly displaced and a spile having a distal end being protruded through said frangible periphery;

wherein, said frangible periphery membrane is in a prescribed yielded state providing a sealable opening having a downwardly turned sealing lip being in biased sealing engagement with said spile.

7. A lid having a spile access means, for sealing closure and automatic sealed access of a filled container, which comprises:

a laminate having a base material and a polymer film bottom surface;

and a plastic access panel that includes, a breakout area having a frangible periphery, an outwardly facing top surface, a downwardly facing bottom, a perimeter flange and a hinge;

said access panel perimeter flange being bonded to said polymer film surface;

said frangible periphery having a thin membrane that is sealingly continuous, between said breakout area and said top surface, with said breakout area being in a normally closed state;

said breakout area being positionable from said closed state to a displaced state wherein said frangible periphery membrane is in a prescribed yielded state providing a sealable opening having a downwardly turned annular sealing lip;

and, wherein said hinge hingingly secures said displaced breakout area to said opening.

8. In the invention of claim 7, said lid being sealingly disposed on and closing a fluid filled pouch, wherein said filled pouch is closed.

9. In the invention of claim 8, said closed pouch being disposed in a dispenser, and said lid having a means for supporting said closed pouch in said dispenser.

10. In the invention of claim 9, a spile being situated in said dispenser and having a distal end that sealingly engages said frangible periphery of said lid breakout area, and said breakout area being in a closed state.

11. In the invention of claim 9, a spile being situated in said dispenser and having a distal end that sealingly protrudes through said frangible periphery of said breakout area and said breakout area is hingingly displaced;

wherein, said frangible periphery member is in a prescribed yielded state providing a sealable opening, having a downwardly turned sealing lip being in biased sealing engagement with said spile.

12. A lid having a spile access means, for sealing closure and sealed access of a filled container, which comprises:

a transverse wall that includes a breakout area having a frangible periphery membrane, an outwardly facing top surface, a downwardly facing bottom, and a hinge;

said membrane being sealingly continuous, between said breakout area and said top surface, with said breakout area being in a normally closed state;

said breakout area being positionable from said closed state to a displaced state wherein said frangible periphery membrane is in a prescribed yielded state providing an opening having a downwardly turned annular sealing lip;

and, in said displaced state said breakout area being hingingly secured to said opening.

13. In the invention of claim 12, said sealing lip having resile memory.

14. In the invention of claim 7, said sealing lip having resile memory.

15. In the invention of claim 1, said sealing lip having resile memory.

* * * * *